US011877684B1

(12) United States Patent
Berney

(10) Patent No.: US 11,877,684 B1
(45) Date of Patent: Jan. 23, 2024

(54) PILLOW WITH VARIABLE INSERTS FOR BACK OF HEAD SUPPORT

(71) Applicant: Robert Berney, Centereach, NY (US)

(72) Inventor: Robert Berney, Centereach, NY (US)

( * ) Notice: Subject to any disclaimer, the term of this patent is extended or adjusted under 35 U.S.C. 154(b) by 0 days.

(21) Appl. No.: 18/174,115

(22) Filed: Feb. 24, 2023

(51) Int. Cl.
*A47G 9/10* (2006.01)

(52) U.S. Cl.
CPC .... *A47G 9/1081* (2013.01); *A47G 2009/1018* (2013.01)

(58) Field of Classification Search
CPC . A47G 9/10; A47G 9/1081; A47G 2009/1018
See application file for complete search history.

(56) References Cited

U.S. PATENT DOCUMENTS 655,087 A * 7/1900 Jones ..... A47G 9/10 5/644
1,447,288 A * 3/1923 Emmerich ..... A47G 9/10 5/645
2,837,145 A * 6/1958 Goetz ..... B61D 33/005 5/652
3,148,389 A * 9/1964 Lustig ..... A47C 27/15 5/643
3,403,414 A * 10/1968 Unger ..... A47G 9/10 5/636
4,185,673 A * 1/1980 Daniello ..... A45C 9/00 383/110
4,508,044 A * 4/1985 Downey ..... A47G 9/10 112/475.08
4,768,248 A * 9/1988 O'Sullivan ..... A47G 9/10 5/640
4,799,275 A * 1/1989 Sprague, Jr. ..... A61F 5/37 5/636
4,959,880 A * 10/1990 Tesch ..... A47G 9/10 5/636
5,020,174 A * 6/1991 Sarkozi ..... A47G 9/10 5/951
5,228,158 A * 7/1993 Park ..... A47G 9/10 5/655.4
5,732,427 A * 3/1998 Parnham ..... A47G 9/1081 5/640
5,898,963 A * 5/1999 Larson ..... A47C 27/084 5/640

(Continued)

FOREIGN PATENT DOCUMENTS

GB 2482871 A * 2/2012 ..... A47G 9/10

*Primary Examiner* — Eric J Kurilla
(74) *Attorney, Agent, or Firm* — Alfred M. Walker; John F. Vodopia

(57) ABSTRACT

A pillow formed by a folded over foam substrate, has attached at its respective distal end an openable inner compartment. The inner compartment can be filled with variable inserts for back of head and neck support, wherein the inserts includes loose fibrous materials or loose pieces of viscoelastic foam, either loose or in discrete closed pouches. This utilizes the softness and support of the materials, to individually vary the softness and support as the user of the pillow chooses. This promotes interchangeability of the interior pillow materials. The pillowcase may include an internal opened sleeve at one end of the pillowcase, to enhance the ease and speed of inserting pillows within pillowcases, with extra manual shoving and manipulation.

14 Claims, 5 Drawing Sheets

(56) References Cited

U.S. PATENT DOCUMENTS 6,952,848 B1 * 10/2005 Strunk-Fellows ..... A47G 9/10 5/636
7,051,389 B2 * 5/2006 Wassilefky ..... B68G 1/00 5/636
7,461,424 B2 * 12/2008 Lindell ..... B68G 1/00 5/636
9,226,605 B1 * 1/2016 Castellano ..... A47G 9/0253
9,462,902 B1 * 10/2016 Rukel ..... A47G 9/007
9,635,963 B2 * 5/2017 Blazar ..... A47G 9/10
10,791,856 B2 10/2020 Berney et al.
10,806,279 B2 10/2020 Berney et al.
10,925,418 B2 * 2/2021 Reuben ..... B68G 3/08
11,141,009 B1 * 10/2021 Rane ..... A47G 9/10
2005/0102757 A1 * 5/2005 Lee ..... A47G 9/10 5/636
2005/0114999 A1 * 6/2005 Cuozzo ..... A47G 9/10 5/636
2006/0031996 A1 * 2/2006 Rawls-Meehan ..... A47C 27/15 5/724
2007/0245493 A1 * 10/2007 Leifermann ..... A47G 9/0253 5/636
2007/0261170 A1 * 11/2007 Hollander ..... A47G 9/0238 5/636
2010/0077551 A1 * 4/2010 Liu ..... A47G 9/10 5/636
2010/0180993 A1 * 7/2010 Gilardi ..... A47G 9/1045 150/154
2011/0061166 A1 * 3/2011 Liu ..... A47G 9/1081 5/636
2012/0066837 A1 * 3/2012 Thorsen ..... A47G 9/10 5/652
2013/0269111 A1 * 10/2013 Berg ..... A47G 9/1027 112/475.08
2014/0082846 A1 * 3/2014 Blazar ..... D05B 11/00 112/475.08
2014/0230151 A1 * 8/2014 Kim ..... A47G 9/1081 5/640
2014/0283303 A1 * 9/2014 Rochlin ..... A47G 9/0253 5/636
2017/0055737 A1 * 3/2017 Rochlin ..... A47G 9/10
2017/0143254 A1 * 5/2017 Bell ..... A61B 5/4815
2018/0199738 A1 * 7/2018 Klein ..... A47G 9/10
2018/0325291 A1 * 11/2018 Holbrook ..... A47G 9/04
2018/0362329 A1 * 12/2018 Reuben ..... B68G 3/08
2019/0290033 A1 * 9/2019 Lonstein ..... A47G 9/10
2019/0298089 A1 * 10/2019 Abdul ..... A47G 9/1027
2020/0069086 A1 * 3/2020 Little ..... B68G 1/00
2020/0154912 A1 * 5/2020 Del Balso ..... A47G 9/10
2023/0115100 A1 * 4/2023 Lim ..... A47C 27/15 5/636

* cited by examiner

Fig. 3
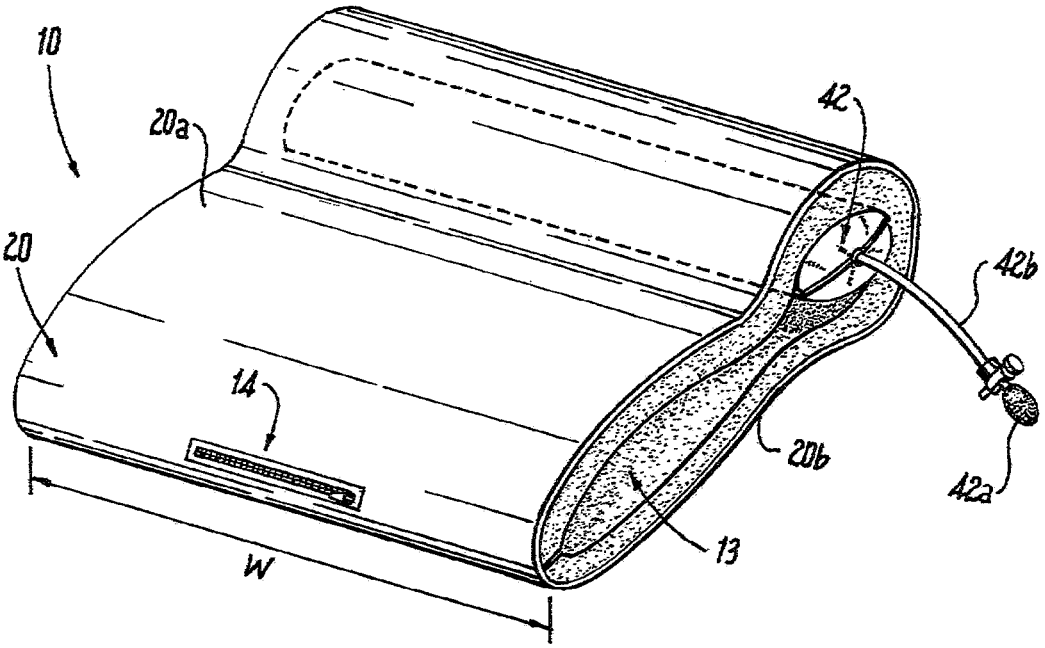
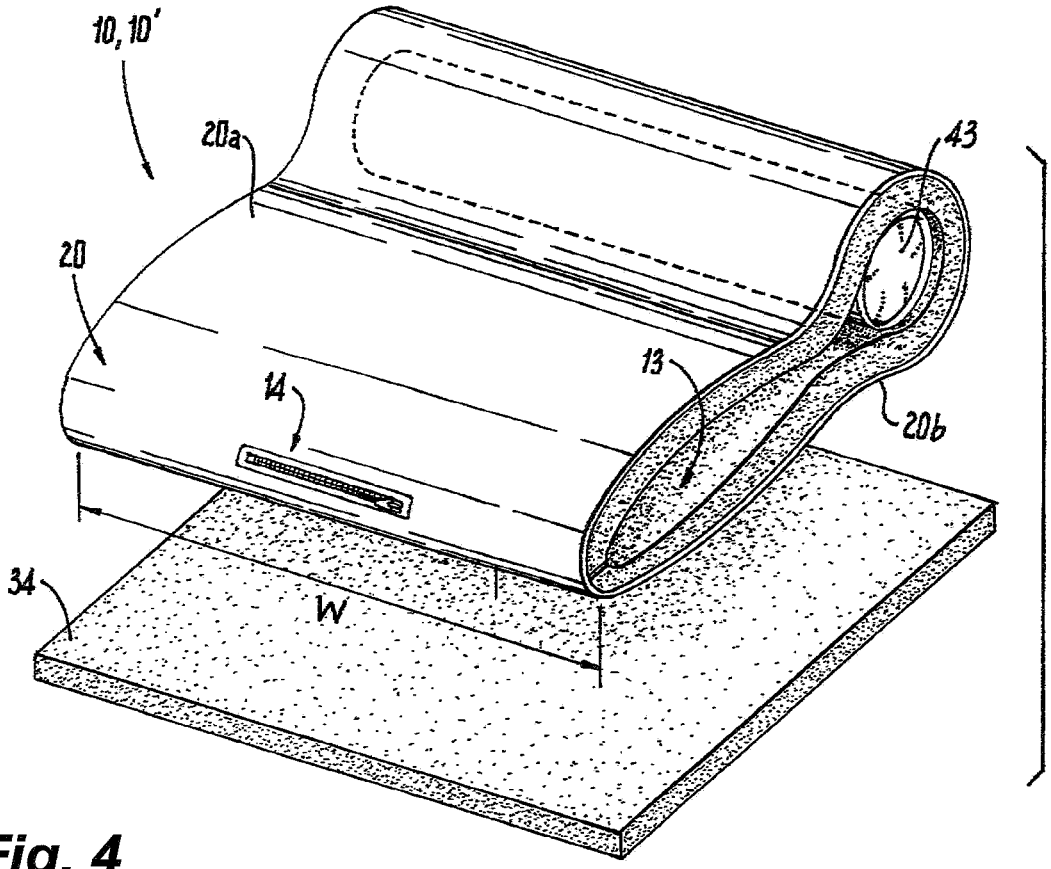
Fig. 4

PILLOW WITH VARIABLE INSERTS FOR BACK OF HEAD SUPPORT

FIELD OF THE INVENTION

The present invention relates to an improved pillow with variable inserts for back of head and neck support.

BACKGROUND OF THE INVENTION

The present invention includes novel improvements over Applicant's prior U.S. Pat. Nos. 10,791,856 ("'856 patent") and U.S. Pat. No. 10,806,279 ("'279 patent") for pillows with inflatable air bladders for cervical neck support and for pillows with one or more foam substrates for adding comfort and support to the back of a user's skull. In FIG. 8 of the '856 and '279 patents, for example, there is disclosed a pillow made up of a folded substrate of foam which forms an interior pillow body where there is an upper portion of the folded substrate of foam and a lower portion of the folded substrate of foam, comprising a padded sleeve 140, where the bend of the fold forms a cylindrical opening arranged for receiving a cylindrical air bladder 142 neck support, as shown. The entire subject matter contents of the '856 and '279 patents are incorporated by reference herein.

OBJECTS OF THE INVENTION

It is therefore an object of the present invention to provide an improved pillow with variable inserts for the back of the head and neck support.

It is also an object of the present invention to provide loose fibrous materials or loose pieces of viscoelastic foam, either as unbounded agglomerations (loose) or loosely bound agglomerations arranged in discrete closed pouches that utilize the softness and support of the fibrous and/or viscoelastic materials, to add to and vary the softness and support provided by the pillow in pillow compartment in which they may be respectively, or together arranged, as the user of the pillow chooses. As should be apparent, the softness of firmness of the pillow is determined by the character of the loose or bound fibrous and/or viscoelastic materials, and volume of same inserted in the pillow compartment. This novel approach promotes interchangeability of the interior pillow materials, at the whim of the user enabling him/her great leeway in the ultimate softness and support for their instant needs.

It is also an object to provide a pillowcase or pillow-fill unit comprising pillow-fill material with an internal sleeve at one end of the pillowcase for access to the pillow-fill material, and a second internal sleeve at a proximal end of the pillowcase that is configured with a reduced-size opening (relative to the size of the opening of the aforementioned internal sleeve), with a closeable opening, into which the unbounded agglomerations (loose) or loosely bound agglomerations arranged in discrete closed pouches are inserted. This pouch with the reduced-size opening in the inventive pillow and/or pillow case readily enhances the ease and speed of inserting pillows and/or unbounded loose) or loosely bound agglomerations within the pillowcases, with extra manual shoving and manipulation.

Other objects which become apparent from the following description of the present invention.

SUMMARY OF THE INVENTION

Instead of choosing one of the flat substrates of Applicant's '856 patent, the present invention includes a fillable pocket in the mid portion at the proximate end thereof, of the pillowcase to support the back of the user's skull, which has a zipper to open up and insert loose pillow fibers or loose pieces of viscoelastic foam (i.e., loose agglomerations), or bound agglomerations, each separated by a thin, fabric divider and by a pillow of either conventional pillow fill material, or by an interior folded foam insert, which when folded, provides sufficiently or desirably soft but firm support as a pillow member itself.

These two arrangements of fibrous, preferably cotton material, and/or of a plurality of foam, preferably viscoelastic foam, pieces, can be inserted into the pocket loose, or they can be accumulated in a ZIP-LOC® or otherwise closable pouch bag with a user-determined amount of fibers or viscoelastic foam. One or more bags can be inserted in the pocket if the pocket is not filled completely with the loose layers or agglomerations of fibers or viscoelastic foam pieces.

For example, a head and neck support pillow includes the following:

a) the pillow having one or more relatively-small fillable pockets (for example, 12 inches or less and preferably 8 inches, relative to other pillow pockets that are approximately 18 inches) in a mid-portion thereof, b) an openable and closable fastener for opening and closing the relatively small fillable pocket; preferably, the relatively-small fillable pocket has a relatively reduced size opening; and c) the pocket being filled with an agglomeration of fibrous cotton material in a lower compartment thereof below an interior folded foam substrate separating the lower compartment from an upper compartment containing fiber/foam inserts; alternatively, the pocket being filled with a bound agglomeration of fibrous cotton or pieces of viscoelastic material, where a bag or other bound means is used to effect the bound nature of the bound agglomeration;

d) whereby the one or more pockets, when filled, support the back of a user's head; and e) whereby softness of contents of the one or more pockets is subject to being varied as a user chooses, by adjusting an amount or of fibrous material or viscoelastic pieces arranged in the one or more pockets) such as where the cotton material is on the top and fibrous viscoelastic foam pieces are on the bottom of the interior of the pillow.

The pillow's openable and closable fastener, as well as the relatively-small fillable pocket's closeable fastener can be a zipper or a hook-and-loop fastener, or any other fastener known to those persons skilled in the art of pillow making. The openable and closable fasteners are preferably arranged on one side of the pillow, where the two top and bottom portions of the folded over foam substrate are joined together.

The fibrous cotton material can be in the form of loose cotton fibers and the fiber/foam inserts can be in the form of loose pieces of viscoelastic foam pieces. Additionally, the material and inserts may be enclosed in closable pouch bags, one or more bags filling the interior pocket of the pillow, i.e., in a bound agglomeration.

In an alternate embodiment, the invention embodies a pillowcase for a pillow, the pillow providing head and neck support for a user, where the pillowcase is manufactured with a full opening on one end of the pillowcase, and a partial opening on another end of the pillowcase. The pillowcase of this embodiment also has an interior pocket along a closed side thereof extending from an opening for the pillow to a closed end of the pillowcase. The pocket is open fully at one end and partially open at the opposite end.

The partially open pocket at the opposite end includes a sewn-in sleeve extending through a portion of the interior pocket of the pillowcase; this partially open pocket permits the user to insert the user's hand into the sewn-in sleeve to reach a pillow therein, or insert a pillow into the pillowcase and pulled/pushed by the user's hand until the pillow is completely in the pillowcase. The partially closed portion outside of the open sewn-in sleeve maintains the pillow in place in the pillowcase.

BRIEF DESCRIPTION OF THE DRAWINGS

The present invention can best be understood in connection with the accompanying drawings. It is noted that the invention is not limited to the precise embodiments shown in the following drawings, in which:

FIG. 3 is a perspective view of the compartments of the pillow embodiments of FIGS. 1 and 2, to highlight that the width and depth of the respective open compartments may be varied.

FIG. 4 is an exploded perspective view of the pillow of FIGS. 1 and 2 arranged above a flat foam substrate, which flat foam substrate may be folded and inserted as part of the pillow portion in the pillowcase of the pillow.

DETAILED DESCRIPTION OF THE INVENTION

Figure 1:
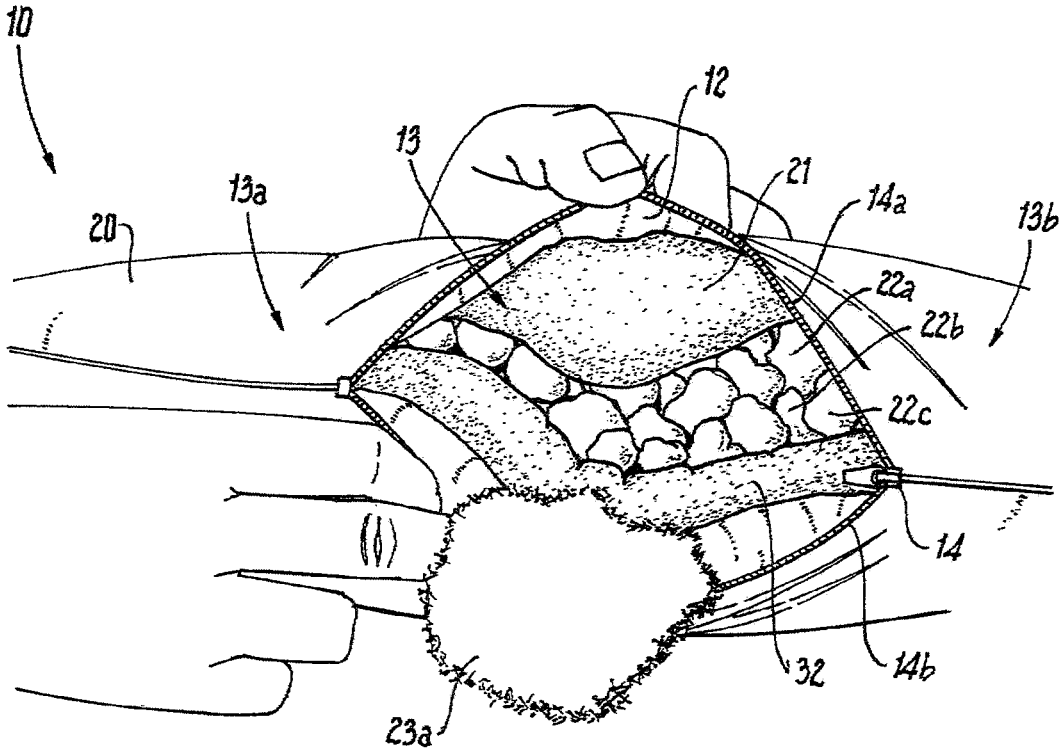
FIG. 1 is a perspective view of an inner compartment of the pillow of the present invention, shown with a lining of an open compartment in an open position with fibrous cotton material in a lower portion thereof below an interior folded foam substrate pillow, separating the compartment into an open pocket with the fiber/foam inserts in the upper portion of the compartment, such as viscoelastic foam pieces in the upper portion thereof; the fibrous cotton material and viscoelastic foam pieces are preferably in bound and/or unbound agglomerations for ready handling.

The present invention can best be understood in connection with the accompanying drawings. It is noted that the invention is not limited to the precise embodiments shown in the following drawings, in which:

In a first embodiment, FIG. 1 shows a pillow 10 formed with an inner compartment 13, a quilt lining 12 of the compartment 13, which is shown in an open position with an agglomeration of unbound fibrous cotton material 23*a* in a lower portion thereof below an interior folded foam substrate 32, 32*a* separating the compartment 13 into an open pocket with the viscoelastic foam inserts 22*a*, 22*b*, 22*c* in the upper portion of the compartment 13, such as the unbound viscoelastic foam pieces 22*a*, 22*b*, 22*c* in the upper portion thereof.

Figure 2:
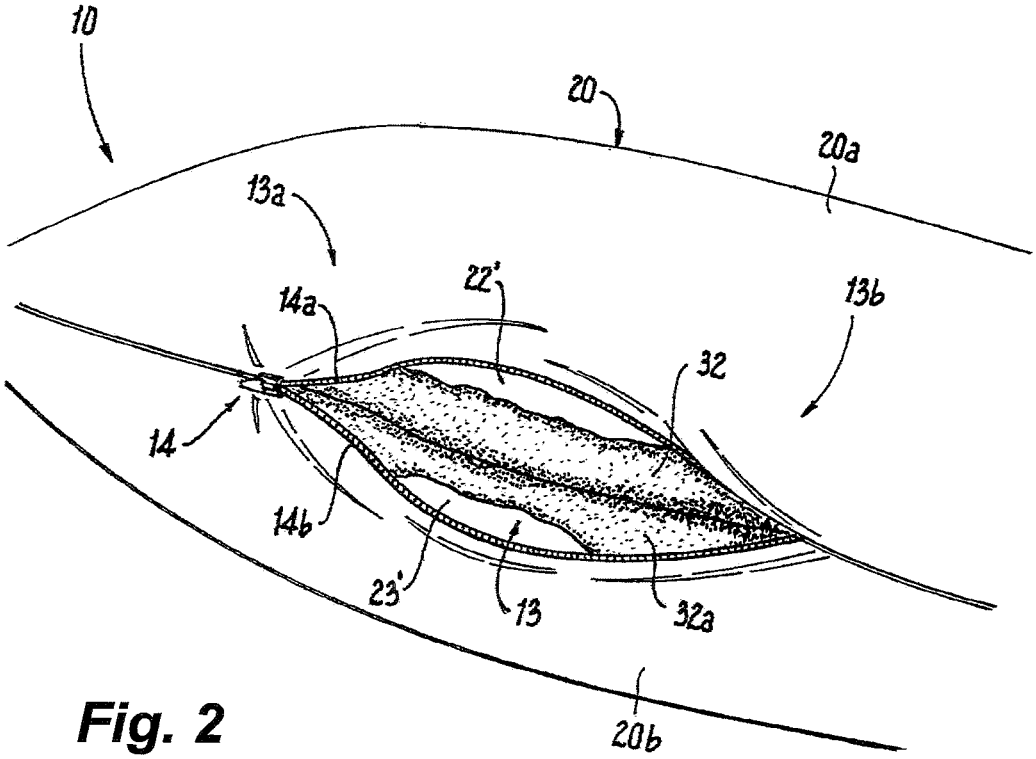
FIG. 2 is a perspective view of an alternative embodiment of the inventive pillow of FIG. 1 that is provided with closed pouches for an agglomeration of fibrous cotton material and fiber foam inserts that have been inserted within the compartment shown in FIG. 1.

It is further noted that while FIG. 1 shows the fibrous cotton pieces 23*a* and viscoelastic foam pieces 22*a*, 22*b*, 22*c* inserted directly into the cavity of the upper and lower portions of the open compartment 13 (unbound agglomerations), and that preferably, as an option, shown in pillow 10' in FIG. 2, the fibrous cotton pieces 23*a* and viscoelastic foam pieces 22*a*, 22*b*, 22*c* can each be separately enclosed in respective closed pouches 22' and 23' (bound agglomerations), where pouch 22' contains foam pieces 22*a*, 22*b*, 22*c* in a closed setting (bound agglomerations), and where pouch 23' contains the fibrous cotton pieces 23*a*, also in a closed setting. In an unbound state, the fibrous cotton pieces 23*a* and viscoelastic foam pieces 22*a*, 22*b*, 22*c* may be said to be loose agglomerations and in the pouches 22', 23', bound agglomerations.

The open compartment 13 is openable and closable by use of the fastener, such as the zipper 14 with closable zipper pieces 14*a* and 14*b*, shown in FIGS. 1 and 2. Other fasteners, such as snaps or hook-and-loop fasteners (VELCRO®), may be used to close the open compartment 13 shown in FIGS. 1 and 2.

Additionally, as shown in FIG. 3, while the compartment 13 may have a width equal to the opening of the zipper 14, as shown, and a depth extending rearward towards the separate prior art air bladder neck support 42 or a cylindrical soft compressible foam piece 43 at the opposite side of the pillows 10, 10', the width and depth of the open compartment 13 may vary in any dimensions up to the entire width "VW" or depth of the pillows 10, 10' themselves, where the compartment 13 has further open wing portions 13*a* and 13*b* extending inside the exterior foam substrate 20 having the top outer pillow surface 20A, variable up to the edges of the bottom outer pillow surface 20B.

Figure 5:
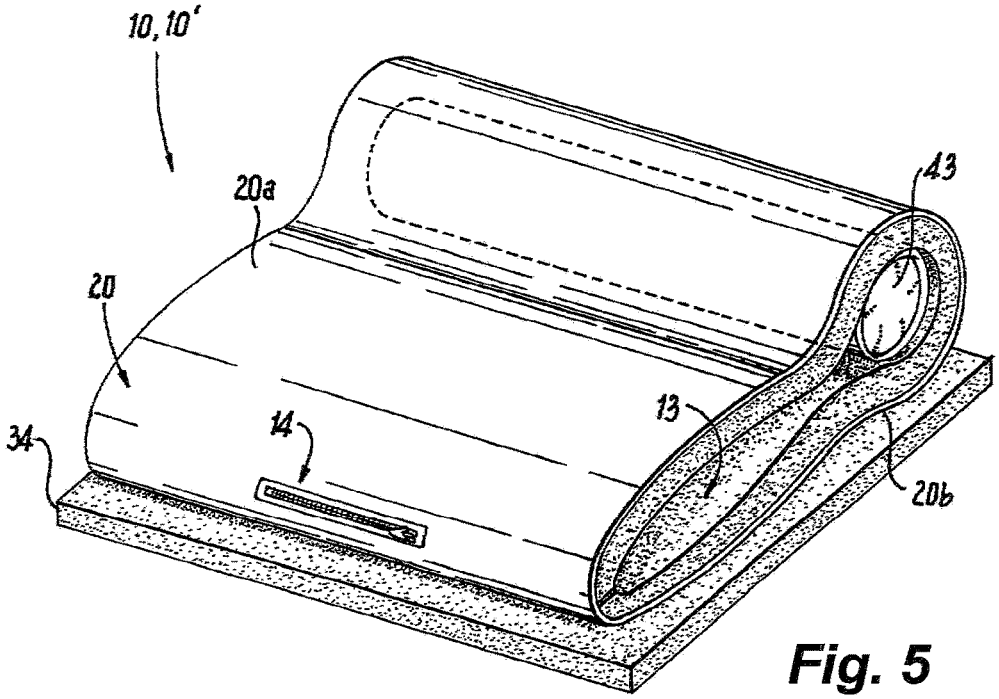
FIG. 5 is a perspective view showing the pillows of FIGS. 1 and 2 directly arranged on top of the flat foam substrate, which was shown separated from the pillows in FIG. 4.

The present invention shown in FIG. 4 and FIG. 5 highlights that pillows 10, 10' optionally do not have the airbladder for the neck support but could have a soft compressible foam cylindrical neck support 43 for additional support. FIGS. 4 and 5 also show the foam substrate 34, which may be provided so that pillows 10, 10' sit on top of substrate 34, which provides further optional support beneath pillows 10, 10'.

Figure 6:
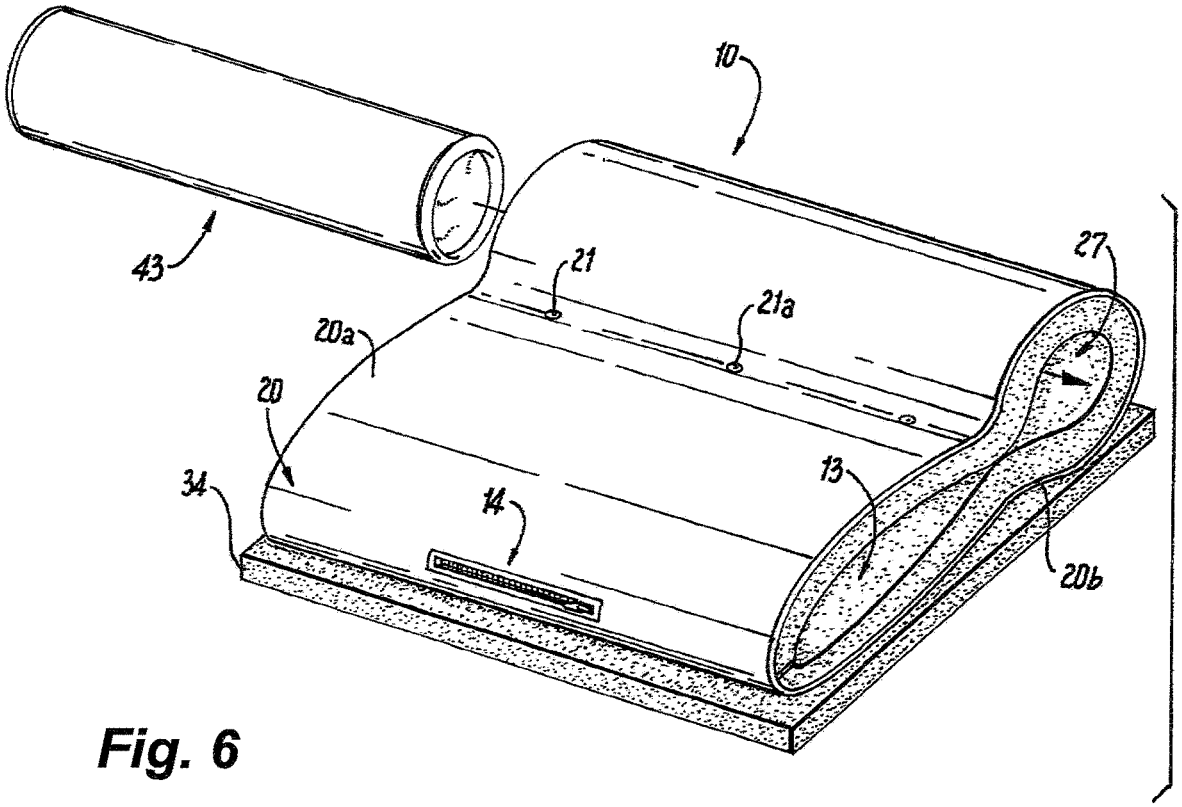
FIG. 6 is an exploded perspective view of the pillows of FIGS. 1 and 2, showing folded over top and bottom foam substrate portions, and including a side-to-side hollow compartment opening on both sides of the pillows, where the pillows have a proximal bulging hollow rear portion for insertion of a cylindrical neck support, and a distal closed front portion with a zippered compartment for insertion of one or more soft compressible viscoelastic foam pieces, or fibrous cotton material in respective loose or bound agglomerations.

FIG. 6 is an exploded perspective view of the embodiments of FIGS. 1, 2, for the pillows 10, 10' showing folded over exterior foam substrate 20 having top and bottom exterior foam substrate portions 20A and 20B, including a side-to-side hollow compartment 13 opening on both sides, where the pillows 10, 10' have a proximal bulging hollow rear portion 27 formed to allow insertion of a cylindrical neck support 42 or 43, as in Berney and Mikell '856 and '279.

The novelty described in pillows 10, 10', as in FIG. 6 herein, is in the addition of a distal closed front portion with a zippered compartment 13, having a zipper 14, for insertion of one or more agglomerations of soft compressible pieces of foam 22*a*, 22*b*, 22*c*, or cotton 23, as well as a folded over interior foam substrate with upper 32 and lower 32*a* portions (see FIGS. 1, 2). The exterior foam substrate 20, having top and bottom exterior upper and lower foam portions 20A and 20B, may have a quilting material 21. In order to make the proximal bulging hollow rear portion 27, a pair or more of stitching or buttons 21 and 21*a* may be provided to create the cylindrical bulging hollow rear portion 27 for insertion of the cylindrical support 43 or air bladder 42 therein. For that matter, the agglomerations make be bounded (pouches 22', 23') or unbounded (a loose stuffing), where the amount of fibrous material or viscoelastic pieces that are inserted define the softness/firmness the compartment imparts.

Figure 7:
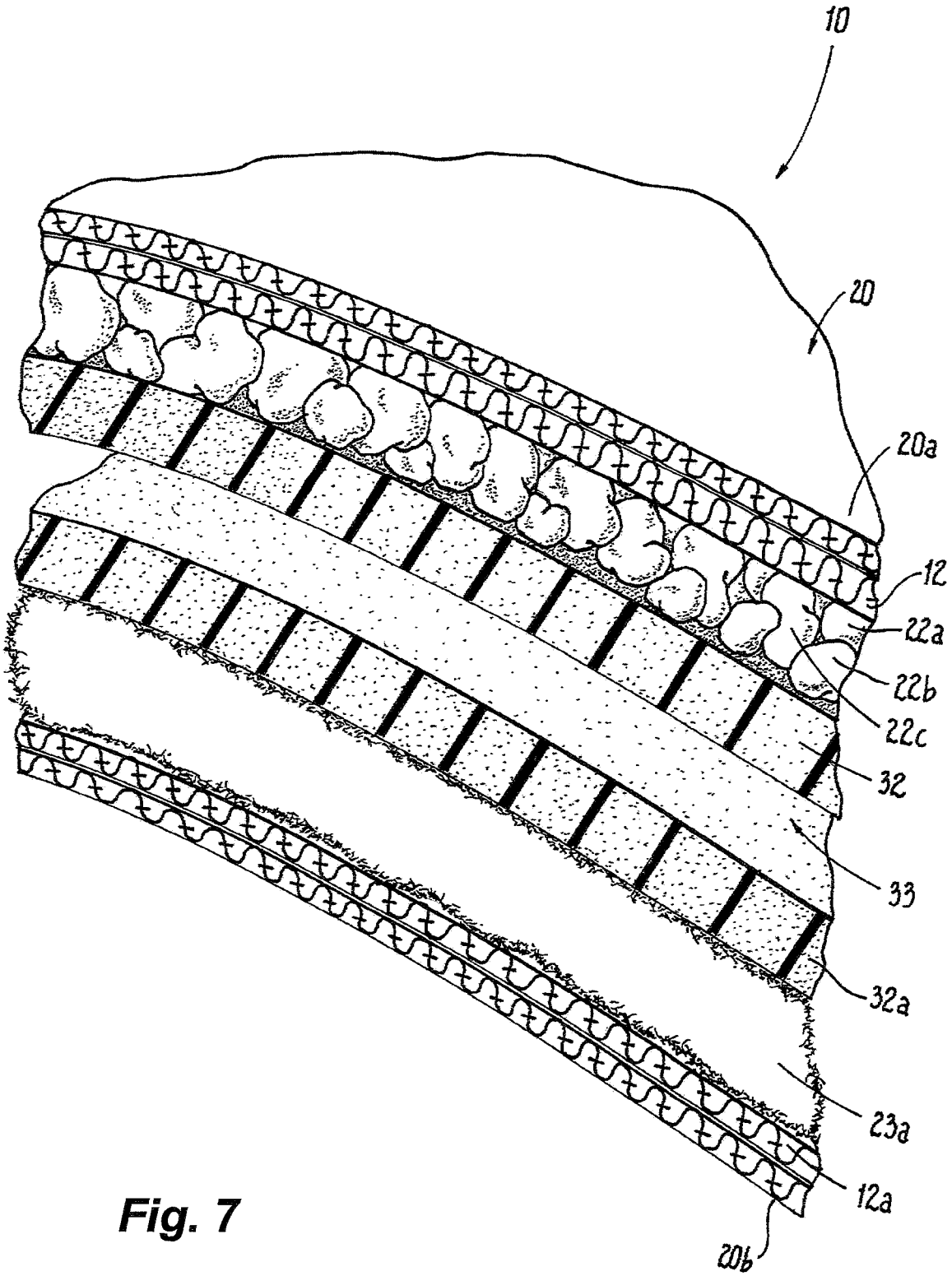
FIG. 7 is a side, cross sectional view, showing the top-to-bottom substantially parallel layers comprising the inside components of the inventive pillows.

FIG. 7 is a side, cross-sectional view showing the top-to-bottom parallel layers of the inside components of the pillow 10. On the top of pillow 10 is the exterior foam substrate 20, having the outer half portion of viscoelastic or other foam material layer 20A, which has a quilt 12 underneath, above an open inner compartment 13 having viscoelastic foam pieces 22*a*, 22*b*, 22*c*, (either loosely filled, or in separate closed pouch, (as in pillow 10') i.e., bound agglomeration, above a top portion 32 of an inner folded foam substrate, which is above a central space 33, that can be optionally filled with any soft compressible material (in a bound or unbounded arrangement). Below the central space 33 is the lower portion 32*a* of the folded inner foam substrate, which is on top of an area holding either loose fibrous cotton material 23*a* (unbound agglomeration) or a closed pouch (as in pillow 10') of cotton 23' (bound agglomerations), which is above a quilt lining 12*a* attached to the lowermost half portion 20B of the folded viscoelastic or other foam material layer of the exterior foam substrate 20.

It is noted that while FIG. 7 shows the main exterior body of the pillow 10 being formed by an exterior foam substrate 20 folded over into connected top and bottom substrates portions 20A and 20B, it is noted that conventional pillow bodies can also have an inner compartment 13. Inner compartment 13 has a quilt lining 12, shown in FIG. 7 in an open position with fibrous cotton material 23*a* in a lower portion thereof below an interior folded foam substrate 32, 32*a* separating the compartment 13 into an open pocket with the viscoelastic foam pieces 22*a*, 22*b*, 22*c* in the upper portion of the compartment 13. In such pillows the exterior portion would reflect a conventional pillow construction but where the inner compartment 13 is provided, also with optional portions for fibrous cotton material 23*a* and for viscoelastic foam pieces 22*a*, 22*b*, 22*c* that are separated from each other by separation substrates, similar to inner foam substrates 32.

Figure 8:
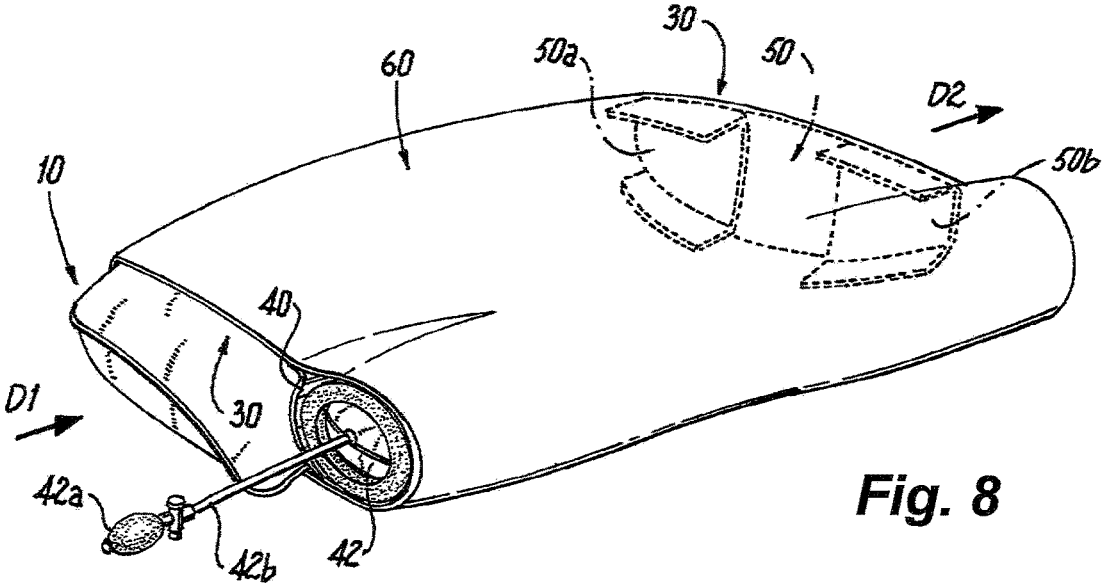
FIG. 8 is a perspective view of an alternate embodiment of the pillow first presented in FIGS. 1 and 2, where in the FIG. 8 pillow embodiment is shown in a pillowcase that is open at both ends, including a full opening at one end, and a partial hand-insertable opening at the opposite end.
Figure 9:
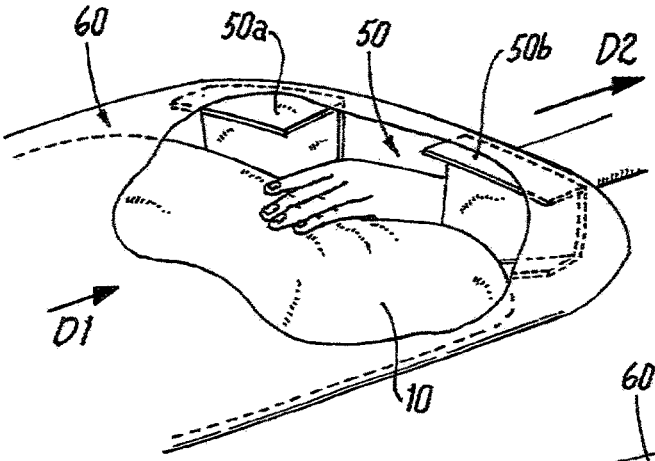
FIG. 9 is a top-plan view in cross section of the FIG. 8 pillowcase, showing the hand of a user being inserted into the partial hand-insertable opening and grabbing the pillow that was previously inserted in the full opening at the opposite end of the pillowcase; in the figure, directional arrow D1 highlights the insertion full opening end of the pillowcase and directional arrow D2 highlights the opposite hand-insertable opening end of the pillowcase through which the pillow is inserted and/or removed; the insertion arrows are axially oriented in positional register with each other.
Figure 10:
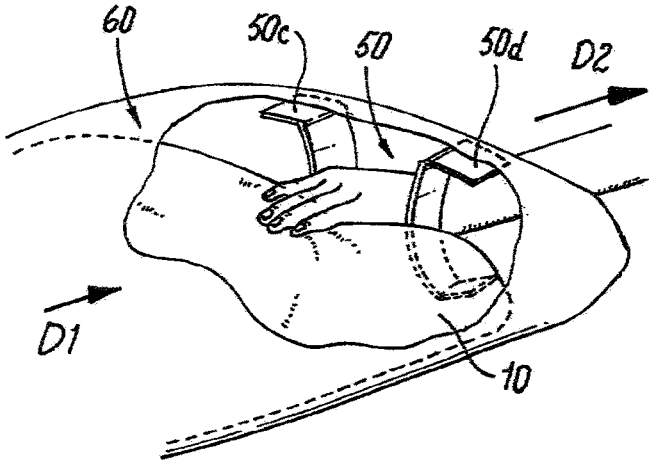
FIG. 10 is a top-plan view in cross section of the inventive pillow and pillowcase of FIG. 8, showing the hand of a user being inserted into partial hand-insertable opening of the pillowcase, and grabbing the pillow, which has been inserted in the full opening at the opposite end, where directional arrow D1 is shown for the insertion full opening end of the pillowcase and directional arrow D2 is shown for the opposite hand-insertable opening end of the pillowcase; like in FIG. 9, the insertion arrows are axially oriented in positional register with each other.

The invention also provides a pillowcase 100, as shown in FIGS. 8, 9 and 10, Pillowcase (with pillow 10 shown inserted therein) is open at both side edges 30, but one of the side edges has a smaller fabric open sleeve 50 than the other open side edge 30. This opposing opening arrangement is provided to enable persons to insert his/her hand into the smaller opening of sleeve 50 to grab the pillow 10 being inserted at the larger opposite open side edge 30 (or already inserted therein). The sleeve 50 preferably is formed by sewn fabric insert pieces 50*a* and 50*b* as shown in FIG. 9, or optionally sewn fabric insert pieces 50*c* and 50*d* of different sizes and geometric configuration, as in FIG. 10, which are attached to the inside 60 of the pillowcase 100, so that the user's hand can reach inside the pillowcase and pull the pillow 10 towards the sleeve 50.

A benefit of the smaller sleeve 50 is that the pillow 10, 10', or even a conventional pillow, will not fall out of the pillowcase 100, as would happen if the opposite edge were completely open with no restraint preventing the pillow from falling out of the opposite side edge of the pillowcase. Additionally, the hand of a user inserting a pillow needs only a width of about 3-4 inches to comfortably reach through the pillowcase 100 to grab the pillow 10, 10' at the opposite completely open side edge 30, and pull the pillow 10 in the direction of directional arrows, D1 and D2, which are in positional register axially with each other, parallel to the open axis of the pillow 10, 10' within pillowcase 100, forming a comfortable pillow set.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended Claims.

I claim:

1. A head and neck support pillow, comprising: a pillow body; a fillable pocket in a mid-portion of the pillow body; means for opening and closing said fillable pocket; and wherein said fillable pocket is filled, or partially filled with an agglomeration of fibrous cotton material in a lower compartment thereof, the lower compartment separated from an upper compartment by an interior folded foam substrate; wherein the upper compartment contains an agglomeration of loose or bound fibrous material or viscoelastic foam pieces; wherein said pocket when filled supports the back of a user's head; and wherein a compactness and/or a softness of said pocket is defined by an amount of material and/or pieces provided therein subject to being varied as a user chooses.

2. The pillow of claim 1, wherein said opening means comprises a zipper or a hook-and-loop fastener.

3. The pillow of claim 2, wherein said opening means is on one side of said pillow.

4. The pillow of claim 1, wherein said fibrous cotton material is an agglomeration of loose cotton fibers.

5. The pillow of claim 4, wherein said agglomeration of loose or bound fibrous material or viscoelastic foam pieces are formed as an agglomeration of loose pieces of viscoelastic foam pieces.

6. The pillow of claim 5, wherein said agglomerations of said material and inserts is a bound agglomeration that is enclosed in closable pouch bags arranged to fill said pocket in said pillow.

7. The pillow of claim 1, wherein said pillow is formed from a folded outer substrate of viscoelastic or other foam material joined at respective distal ends of said folded outer substrate of viscoelastic foam, whereby an outer surface of said pillow is open at both sides but closed at a front distal end and at a rear proximal end thereof; said proximal end of said pillow includes a bulging hollow cylindrical compartment for insertion of a neck support selected from the group consisting of an inflatable air bladder or a cylindrical foam insert; said pocket is filled by said fibrous cotton material in said lower compartment thereof below said folded inner foam substrate separating said lower compartment from said upper compartment containing said agglomeration of loose or bound fibrous material or viscoelastic foam pieces inside said pocket; a top of said pillow is provided with an outer top half portion of said folded outer substrate of viscoelastic or other foam material layer, said outer top half portion of said folded substrate having a quilt underneath, and, a bottom of said pillow is provided with an outer lower half portion of said folded outer substrate of viscoelastic or other foam material layer, said outer lower half portion of said folded substrate having a quilt underneath.

8. The pillow as in claim 1, further comprising a separate substrate of foam placed underneath said pillow.

9. A method of providing support in a pillow for the back of a user's head, comprising the steps of: forming a fillable pocket in a mid-portion of said pillow; providing means for opening and closing said fillable pocket; and filling said pocket with an agglomeration of fibrous cotton material in a lower compartment thereof below an interior folded foam substrate separating said lower compartment from an upper compartment containing an agglomeration of loose or bound fibrous material or viscoelastic foam pieces; wherein said user uses said pillow by resting a back of his or her head on said mid-portion of said pillow; and wherein said user varies a softness of said pillow by defining an amount of said bound or loose agglomeration of fibrous material or pieces of viscoelastic foam material inserted in said pocket, according to his or her needs.

10. The method of claim 9, wherein said opening means comprises a zipper or a hook-and-loop fastener.

11. The method of claim 9, wherein said opening means is on one side of said pillow.

12. The method of claim 9, wherein said agglomeration of said fibrous cotton material is in the form of loose cotton fibers.

13. The method of claim 12, wherein said agglomeration of loose or bound fibrous material or viscoelastic foam pieces are formed as loose pieces of viscoelastic foam pieces.

14. The method of claim 12, where said agglomeration of fibrous cotton material and agglomeration of loose or bound fibrous material or viscoelastic foam pieces are bound agglomerations enclosed in closable pouch bags, one or more bags filling said pocket in said pillow.

* * * * *